US006526247B2

(12) United States Patent
Stelter et al.

(10) Patent No.: US 6,526,247 B2
(45) Date of Patent: Feb. 25, 2003

(54) ELECTROSTATIC IMAGE DEVELOPING PROCESS WITH OPTIMIZED SETPOINTS

(75) Inventors: Eric C. Stelter, Pittsford, NY (US); Joseph E. Guth, Holley, NY (US); Matthias H. Regelsberger, Rochester, NY (US); Edward M. Eck, Lima, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/855,384

(22) Filed: May 15, 2001

(65) Prior Publication Data

US 2001/0043822 A1 Nov. 22, 2001

Related U.S. Application Data

(60) Provisional application No. 60/204,882, filed on May 17, 2000.

(51) Int. Cl.[7] ..... G03G 15/09
(52) U.S. Cl. ..... 399/267; 399/276; 399/275
(58) Field of Search ..... 399/265, 266, 399/267, 270, 275, 276, 277

(56) References Cited

U.S. PATENT DOCUMENTS

| | | | |
|---|---|---|---|
| 4,473,029 | A | 9/1984 | Fritz et al. |
| 4,496,643 | A | 1/1985 | Wilson et al. |
| 4,531,832 | A | 7/1985 | Kroll et al. |
| 4,546,060 | A | 10/1985 | Miskinis et al. |
| 4,602,863 | A | 7/1986 | Fritz et al. |
| 4,634,286 | A | 1/1987 | Pike |
| 4,637,973 | A | 1/1987 | Shigeta et al. |
| 4,671,207 | A | 6/1987 | Hilbert |
| 4,714,046 | A | 12/1987 | Steele et al. |
| 4,764,445 | A | 8/1988 | Miskinis et al. |
| 4,825,244 | A | 4/1989 | Hediger |
| 4,887,132 | A | 12/1989 | Joseph et al. |
| 4,922,302 | A | 5/1990 | Hill et al. |
| 4,949,127 | A | 8/1990 | Matsuda et al. |
| 4,967,236 | A | 10/1990 | Rodenberg et al. |
| 5,001,028 | A | 3/1991 | Mosehauer et al. |
| 5,019,796 | A | 5/1991 | Lee et al. |
| 5,040,003 | A | 8/1991 | Willis |
| 5,043,760 | A | 8/1991 | MacLellan et al. |
| 5,047,807 | A | 9/1991 | Kalyandurg |
| 5,049,471 | A | 9/1991 | Higashiguchi et al. |
| 5,061,586 | A | 10/1991 | Saha et al. |
| 5,063,399 | A | 11/1991 | Zeman et al. |
| 5,066,981 | A | 11/1991 | Kalyandurg |
| 5,084,739 | A | 1/1992 | Kalyandurg et al. |
| 5,095,340 | A | 3/1992 | Mahoney |
| 5,104,761 | A | 4/1992 | Saha et al. |
| 5,106,714 | A | 4/1992 | Saha et al. |
| 5,111,245 | A | 5/1992 | DeCecca et al. |
| 5,132,732 | A | 7/1992 | Kalyandurg et al. |
| 5,138,388 | A | 8/1992 | Kamp et al. |
| 5,146,278 | A | 9/1992 | Kroll et al. |

(List continued on next page.)

FOREIGN PATENT DOCUMENTS

| | | |
|---|---|---|
| JP | 03-170978 | 7/1991 |
| JP | 04-097268 | 3/1992 |
| JP | 10-161423 | 6/1998 |
| WO | WO 85/00438 | 1/1985 |

*Primary Examiner*—Hoang Ngo

(57) ABSTRACT

The invention relates generally to processes for electrostatic image development, and setpoints that provide uniform image development. In particular, an apparatus and process having a magnetic brush that implements hard carriers and a rotating magnetic core within a shell is disclosed. The process implements one or more of the following optimum setpoints: a range of shell surface speeds that provide uniform toning density, a range of shell surface speeds that prevent toner plate-out, a skive spacing that minimizes sensitivity to variation, a magnetic core speed that minimizes sensitivity to variation, and an imaging member spacing that minimizes sensitivity to variation.

14 Claims, 7 Drawing Sheets

U.S. PATENT DOCUMENTS 5,148,220 A 9/1992 Hilbert et al.
5,162,854 A 11/1992 Hilbert et al.
5,182,608 A 1/1993 Kroll et al .
5,184,194 A 2/1993 Mosehauer et al.
5,190,841 A 3/1993 Saha et al.
5,190,842 A 3/1993 Saha et al.
5,196,887 A 3/1993 Hilbert et al.
5,227,265 A 7/1993 DeBoer et al.
5,237,127 A 8/1993 DeCecca et al.
5,239,342 A 8/1993 Kubo et al.
5,241,327 A 8/1993 Rubin et al.
5,245,388 A 9/1993 Rydelek et al.
5,247,331 A 9/1993 Rydelek
5,255,053 A 10/1993 Green et al.
5,268,249 A 12/1993 Saha et al.
5,268,719 A 12/1993 Rydelek et al.
5,280,302 A 1/1994 Rubin et al.
5,282,002 A 1/1994 Jacobs et al.
5,291,259 A 3/1994 Weitzel et al.
5,293,201 A 3/1994 Kamp et al.
5,296,894 A 3/1994 Green et al.
5,296,898 A 3/1994 Rubin et al.
5,296,905 A 3/1994 Yousey et al.
5,298,358 A 3/1994 Rubin et al.
5,300,988 A 4/1994 Westbrook et al.
5,306,592 A 4/1994 Saha
5,313,993 A 5/1994 Corby et al.
5,325,161 A 6/1994 Saha et al.
5,332,645 A 7/1994 Saha et al.
5,339,140 A 8/1994 Zeman et al.
5,344,731 A 9/1994 Deboer et al.
5,347,345 A 9/1994 Osterhoudt
5,347,347 A 9/1994 Hilbert et al.
5,376,492 A 12/1994 Stelter et al.
5,400,124 A 3/1995 Kass et al.
5,409,791 A 4/1995 Kaukeinen et al.
5,484,680 A 1/1996 Goto et al.
5,489,975 A 2/1996 Kaukeinen et al.
5,500,320 A 3/1996 Saha
5,512,404 A 4/1996 Saha
5,592,268 A 1/1997 Uehara et al.
5,640,656 A 6/1997 Hilbert et al.
5,701,550 A 12/1997 Lofftus et al.
5,705,307 A 1/1998 Tyagi et al.
5,713,064 A 1/1998 Kasiske et al.
5,732,311 A 3/1998 May et al.
5,748,218 A 5/1998 Stelter et al.
5,835,832 A 11/1998 Rimai et al.
5,853,941 A 12/1998 Rimai et al.
5,923,933 A 7/1999 Anzai et al.
5,923,937 A 7/1999 Thompson et al.
5,926,679 A 7/1999 May et al.
5,998,076 A 12/1999 Mahabadi et al.
6,125,257 A 9/2000 Sekine et al.

ELECTROSTATIC IMAGE DEVELOPING PROCESS WITH OPTIMIZED SETPOINTS

BACKGROUND

The invention relates generally to processes for electrostatic image development, and setpoints that provide uniform image development.

Processes for developing electrostatic images using dry toner are well known in the art. A process that implements hard magnetic carriers and a rotating magnetic core is described in U.S. Pat. Nos. 4,546,060 and 4,473,029. The rotating magnetic core promotes agitated flow of the toner/carrier mixture, which improves development relative to certain other development processes. In spite of such improvements, certain image artifacts still occur, some of which are the result of process setpoints. Therefore, a more robust process without image artifacts is generally desired.

SUMMARY

A process for developing electrostatic images comprising depositing a uniform toner density on an electrostatic image using a magnetic brush comprising hard magnetic carriers, a rotating shell, and a rotating plurality of magnets inside the rotating shell, without plating-out the rotating shell with toner.

DETAILED DESCRIPTION

Figure 1:
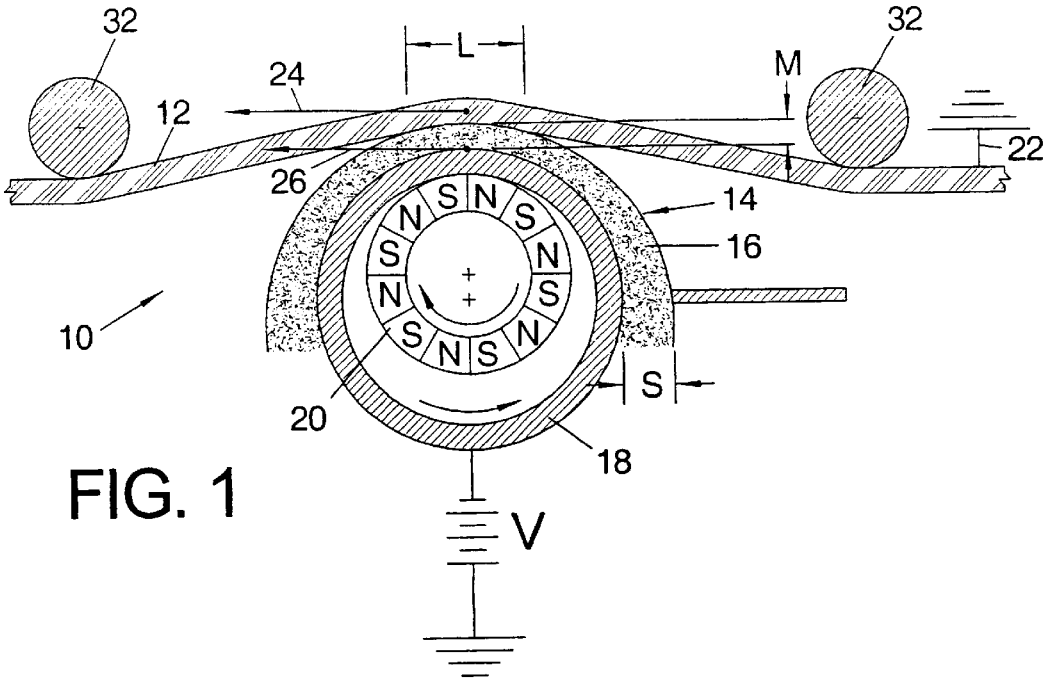
FIG. 1 presents a side cross-sectional view of an apparatus for developing electrostatic images, according to an aspect of the present invention.

Various aspects of the invention are presented in FIGS. 1–15, which are not drawn to scale, and wherein like components in the numerous views are numbered alike. Referring now specifically to FIG. 1, an apparatus and process are presented, according to an aspect of the invention. An apparatus 10 for developing electrostatic images is presented comprising an electrostatic imaging member 12 having an electrostatic image and a magnetic brush 14 comprising a rotating shell 18, a mixture 16 of hard magnetic carriers and toner (also referred to herein as "developer"), and a rotating plurality of magnets 20 inside the rotating shell 18. A process for developing electrostatic images, according to an aspect of the invention, comprises depositing a uniform toner density on the electrostatic image using the magnetic brush 14 comprising hard magnetic carriers, a rotating shell 18, and a rotating plurality of magnets 20 inside the rotating shell 18, without plating-out the rotating shell 18 with toner. As used herein, "plate-out" refers to a condition wherein the external surface of the rotating shell 18 is coated with toner particles to the extent that the image is affected.

The magnetic brush 14 operates according to the principles described in U.S. Pat. Nos. 4,473,029 and 4,546,060, the contents of which are fully incorporated by reference as if set forth herein. The two-component dry developer composition of U.S. Pat. No. 4,546,060 comprises charged toner particles and oppositely charged, magnetic carrier particles, which (a) comprise a magnetic material exhibiting "hard" magnetic properties, as characterized by a coercivity of at least 300 gauss and (b) exhibit an induced magnetic moment of at least 20 EMU/gm when in an applied field of 1000 gauss, is disclosed. As described in the '060 patent, the developer is employed in combination with a magnetic applicator comprising a rotatable magnetic core and an outer, nonmagnetizable shell to develop electrostatic images. When hard magnetic carrier particles are employed, exposure to a succession of magnetic fields emanating from the rotating core applicator causes the particles to flip or turn to move into magnetic alignment in each new field. Each flip, moreover, as a consequence of both the magnetic moment of the particles and the coercivity of the magnetic material, is accompanied by a rapid circumferential step by each particle in a direction opposite the movement of the rotating core. The observed result is that the developers of the '060 flow smoothly and at a rapid rate around the shell while the core rotates in the opposite direction, thus rapidly delivering fresh toner to the photoconductor and facilitating high-volume copy and printer applications.

Figure 2:
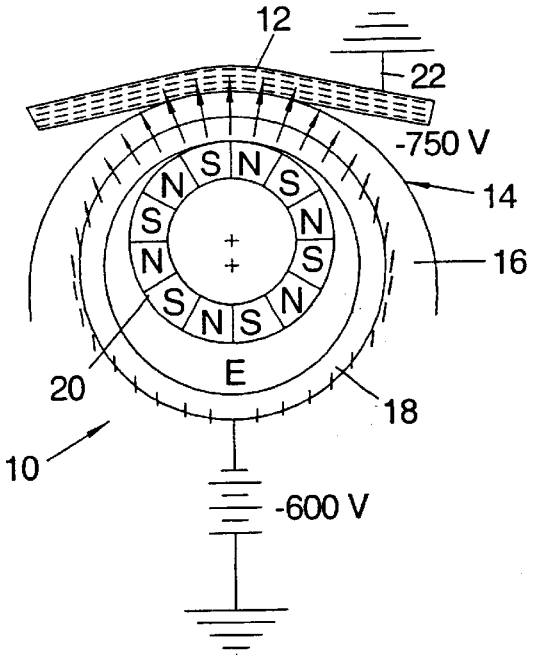
FIG. 2 presents a side schematic view of a discharged area development configuration of the FIG. 1 apparatus with a background area passing over a magnetic brush.
Figure 3:
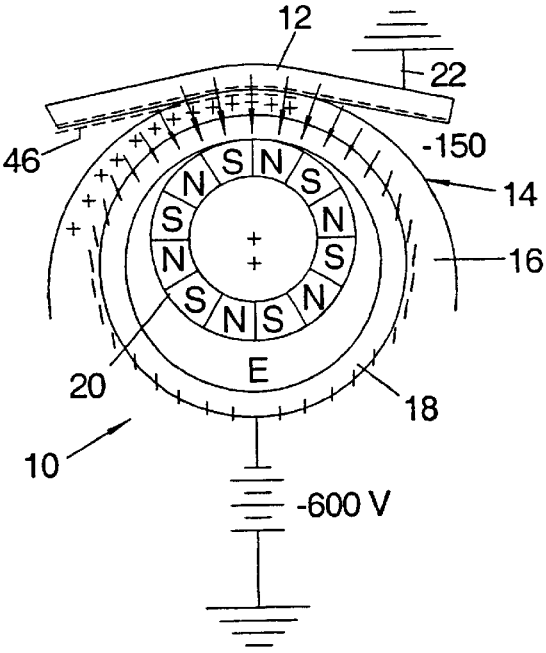
FIG. 3 presents a side schematic view of a discharged area development configuration of the FIG. 1 apparatus with an area that is being toned passing over a magnetic brush.

The electrostatic imaging member 12 of FIGS. 1–3 is configured as a sheet-like film. However, it may be configured in other ways, such as a drum, depending upon the particular application. A film electrostatic imaging member 12 is relatively resilient, typically under tension, and a pair of backer bars 32 may be provided that hold the imaging member in a desired position relative to the shell 18, as shown in FIG. 1.

According to a further aspect of the invention, the process comprises moving electrostatic imaging member 12 at a member velocity 24, and rotating the shell 18 with a shell surface velocity 26 adjacent the electrostatic imaging member 12 and co-directional with the member velocity 24. The shell 18 and magnetic poles 20 bring the mixture 16 of hard magnetic carriers and toner into contact with the electrostatic imaging member 12. The mixture 16 contacts that electrostatic imaging member 12 over a length indicated as L. The electrostatic imaging member is electrically grounded 22 and defines a ground plane. The surface of the electrostatic imaging member facing the shell 18 is a photoconductor that can be treated at this point in the process as an electrical insulator, the shell opposite that is grounded is an electrical conductor. Biasing the shell relative to the ground 22 with a voltage V creates an electric field that attracts toner particles to the electrostatic image with a uniform toner density, the electric field being a maximum where the shell 18 is adjacent to the electrostatic imaging member 12. According to an aspect of the invention, toner plate-out is avoided by the electric field being a maximum where the shell 18 is adjacent to the electrostatic imaging member 12, and by the shell surface velocity 26 being greater than or equal to a minimum shell surface velocity below which toner plate-out occurs on the shell 18 adjacent the electrostatic imaging member 12.

This aspect of the invention is explained more fully with reference to FIGS. 2 and 3, wherein the apparatus 10 is presented in a configuration for Discharged Area Development (DAD). Cross-hatching and arrows indicating movement are removed for the sake of clarity. FIG. 2 represents development of a background area (no toner deposited), and FIG. 3 represents development of a toned area (toner deposited). Referring specifically to FIG. 2, the surface of the electrostatic imaging member 12 is charged using methods known in the electrostatic imaging arts to a negative static voltage, −750 VDC, for example, relative to ground. The shell is biased with a lesser negative voltage, −600 VDC, for example, relative to ground. The difference in electrical potential generates an electric field E that is maximum where the imaging member 12 is adjacent the shell 18. The electric field E is presented at numerous locations proximate the surface of the shell 18 with relative strength indicated by the size of the arrows. The toner particles are negatively charged in a DAD system, and are not drawn to the surface of the imaging member 12. However, the toner particles are drawn to the surface of the shell 18 where the electric field E is maximum (adjacent the electrostatic imaging member 12). Plate-out is avoided by moving the surface of the shell 18 through the contact length L faster than plate-out is able to occur (the minimum shell surface velocity below which toner plate-out occurs on the shell 18 adjacent the electrostatic imaging member 12). Plate-out on the remainder of the shell 18 is prevented by the agitated motion of the mixture 16 induced by the rotating magnet poles 20, and by avoiding placement of any biased structure adjacent the shell 18, other than the electrostatic imaging member 20, that would generate a plate-out causing electric field.

The existence of plate out may be determined experimentally in at least two ways. One, for example, is the appearance of image artifacts as described in U.S. Pat. No. 4,473,029. Alternatively, the magnetic brush 14 may be operated for an extended period of time and subsequently removed. The surface of the shell 18 may then be inspected for plate-out.

Referring now to FIG. 3, the apparatus 10 of FIGS. 1 and 2 is shown with a discharged area of the electrostatic imaging member 12 passing over the magnetic brush 14. The static voltage of −750 VDC on electrostatic imaging member 12 has been discharged to a lesser static voltage, −150 VDC, for example, by methods known in the art such as a laser or LED printing head, without limitation. Note that the sense of the electric field E is now reversed, and negative toner particles 46 are attracted to and adhere to the surface of the electrostatic imaging member. A residual positive charge is developed in the mixture 16, which is carried away by the flow of the mixture 16. Although described in relation to a DAD system, the principles described herein are equally applicable to a charged area development (CAD) system with positive toner particles.

Figure 4:
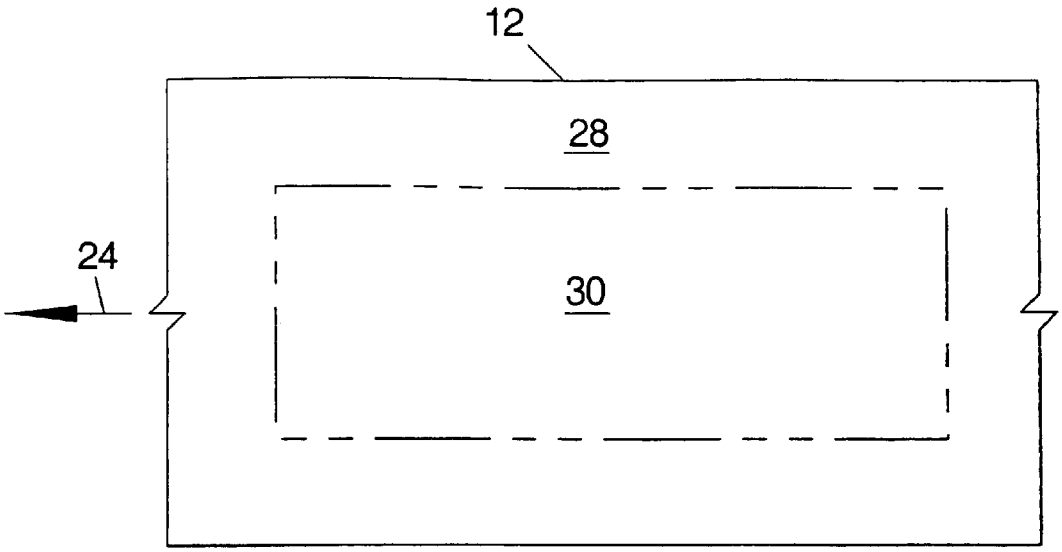
FIG. 4 presents a plan view of an electrostatic imaging member having an electrostatic image.
Figure 5:
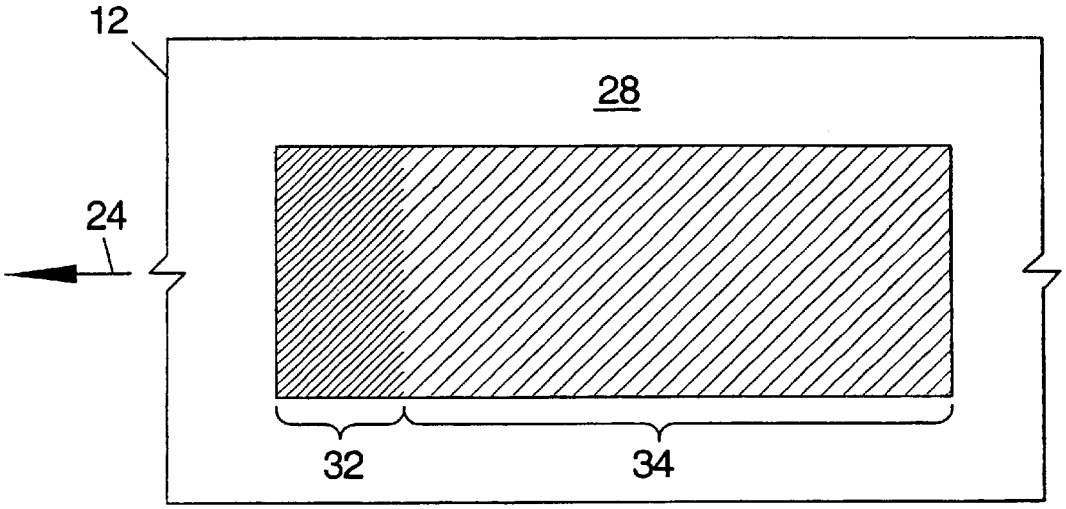
FIG. 5 presents a plan view of FIG. 4 electrostatic imaging member after development.
Figure 6:
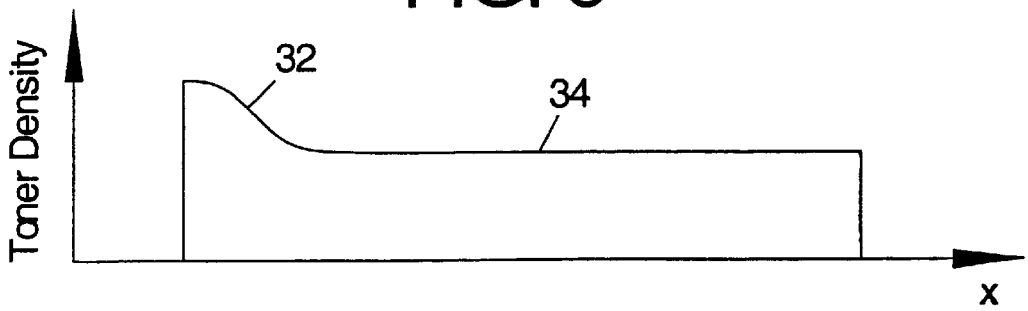
FIG. 6 presents a plot of toning density versus position for the developed image of FIG. 5.

Referring now to FIGS. 4–6, a DAD development process is presented wherein the shell surface velocity 26 (FIG. 1) is too slow. The member velocity 24 is presented in FIGS. 4 and 5 for reference purposes. Referring specifically to FIG. 4, the electrostatic imaging member 12 has an electrostatic image comprising a charged area 28 and a discharged area 30. Referring specifically to FIG. 5, the electrostatic imaging member 12 is presented after passing through the development zone L (FIG. 1). The discharged area 30 of FIG. 4 is now toned. Still referring to FIG. 5, there is a zone 32 of greater toner density on the leading edge of the electrostatic image than on the balance 34 of the electrostatic image. A plot of toner density versus position is presented in FIG. 6.

Figure 7:
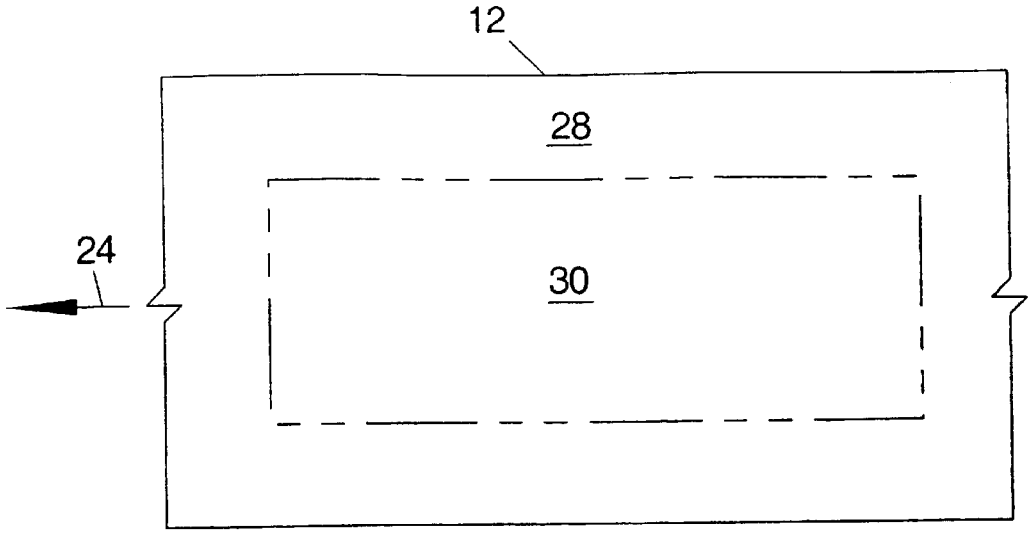
FIG. 7 presents a plan view of an electrostatic imaging member having an electrostatic image.
Figure 8:
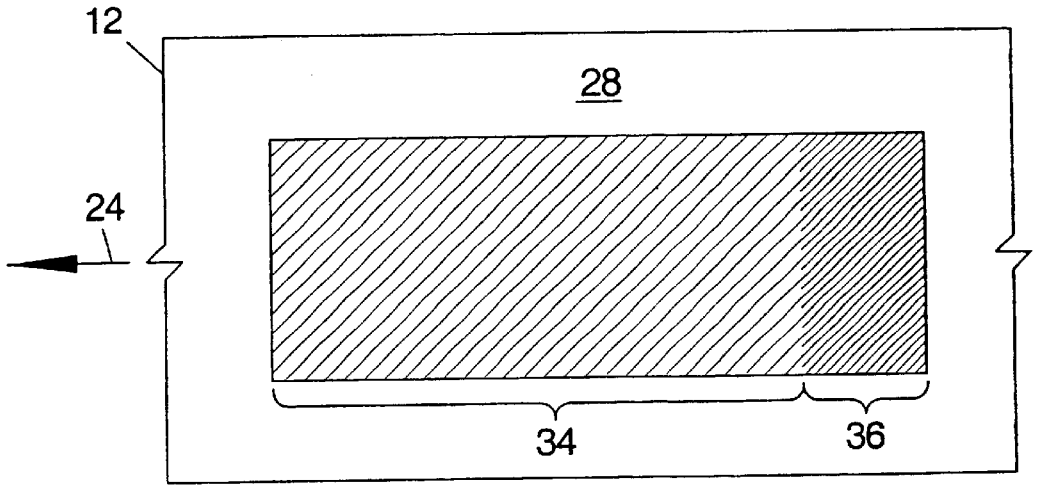
FIG. 8 presents a plan view of FIG. 7 electrostatic imaging member after development.
Figure 9:
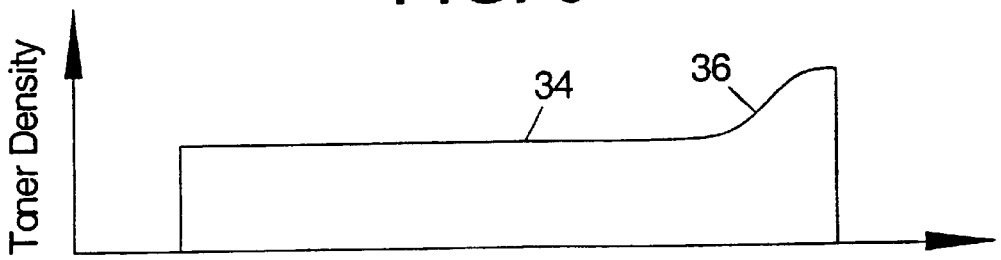
FIG. 9 presents a plot of toning density versus position for the developed image of FIG. 8.

Referring now to FIGS. 7–9, a DAD development process is presented wherein the shell surface velocity 26 (FIG. 1) is too fast. The member velocity 24 is presented in FIGS. 7 and 8 for reference purposes. Referring specifically to FIG. 7, the electrostatic imaging member 12 has the same electrostatic image as FIG. 4 comprising the charged area 28 and the discharged area 30. Referring specifically to FIG. 8, the electrostatic imaging member 12 is presented after passing through the development zone L (FIG. 1). The discharged area 30 of FIG. 7 is now toned. Still referring to FIG. 7, there is a zone 36 of greater toner density on the trailing edge of the electrostatic image than on the balance 34 of the electrostatic image. A plot of toner density versus position is presented in FIG. 9.

Therefore, according to a further aspect of the invention, the shell surface velocity 26 is greater than a shell surface velocity that creates noticeably greater toner density 32 on leading edges of the electrostatic image than on the balance 34 of the electrostatic image (FIGS. 4–6), and less than a shell surface velocity that creates noticeably greater toner density 36 on trailing edges of the electrostatic image than on the balance 34 of the electrostatic image (FIGS. 7–9). Stated differently, there is a maximum shell surface velocity above (greater than) which toner density 36 on the trailing edges is noticeably greater than on the balance 34 of the electrostatic image, and there is a minimum shell surface velocity below (less than) which toner density 36 on the leading edges is noticeably greater than on the balance 34 of the electrostatic image, the shell surface velocity being greater than or equal to the minimum shell surface velocity and less than or equal to the maximum shell surface velocity. In practice, the toned image is transferred to a print media, such a sheet of paper or overhead transparency, without limitation, and the term "noticeably greater" means that the difference in toning density is discernable by the unaided human eye.

According to a further aspect of the invention, the minimum shell velocity is 40% of the member velocity and the maximum shell velocity is 105% of the member velocity. According to a preferred embodiment, the minimum shell velocity is 50% of the member velocity 24 and the maximum shell velocity is 105% of the member velocity 24. According to a particularly preferred embodiment, the minimum shell velocity is 50% of the member velocity 24 and the maximum shell velocity is 100% of the member velocity 24. According to a preferred embodiment, the magnitude of the member velocity 24 is at least 11.4 inches per second and, more preferably, is at least than 15 inches per second. The development zone length L is preferably greater than 0.25 inches.

Figure 10:
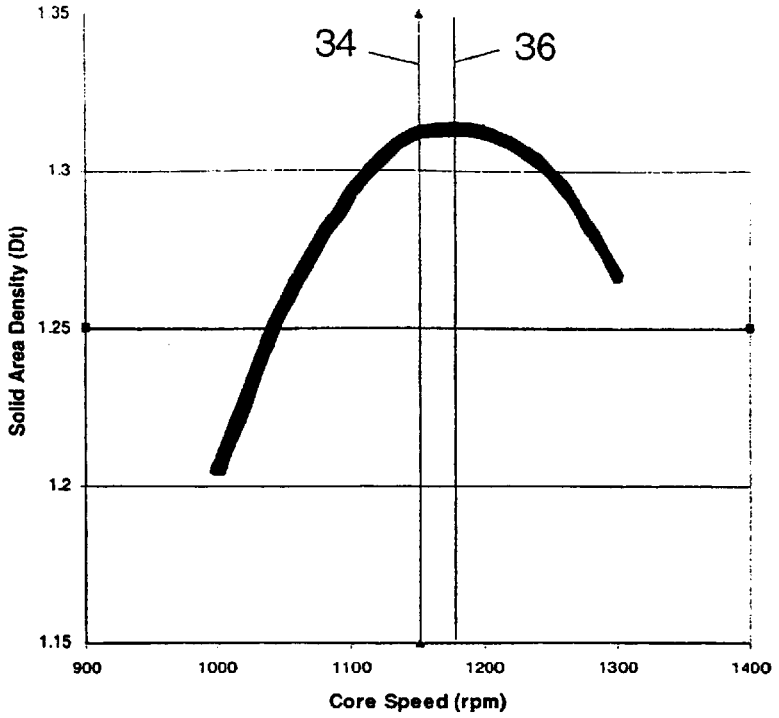
FIG. 10 presents a plot of core speed versus toning density.

According to a further aspect of the invention, certain further setpoints are optimized to improve image uniformity. Referring now to FIG. 10, a plot of core speed versus toning density is presented, showing a core speed setpoint 34, and an actual maximum 36. Here, toning density refers to the transmission density of the toned image on the photoconductor or on the receiver. The core speed is preferably set at the speed where the slope is approximately zero and also a maximum. Gearing limitations may prevent the core speed setpoint 34 from corresponding to the actual maximum 36. According to a preferred embodiment, the setpoint 34 is close enough to the actual maximum such that gear chatter does not appear in the developed image.

Figure 11:
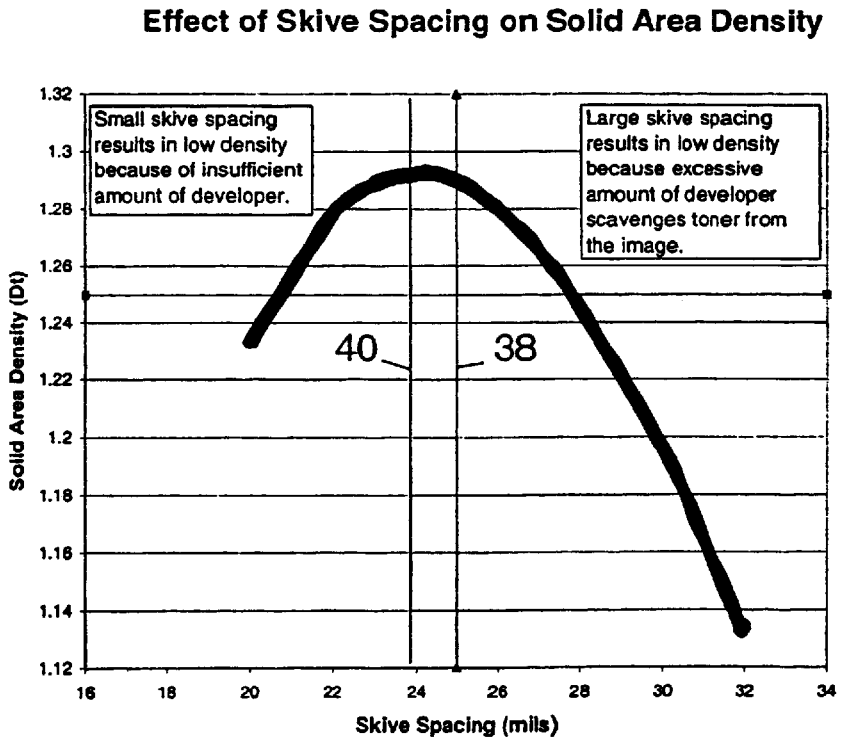
FIG. 11 presents a plot of skive spacing versus toning density.
Figure 12:
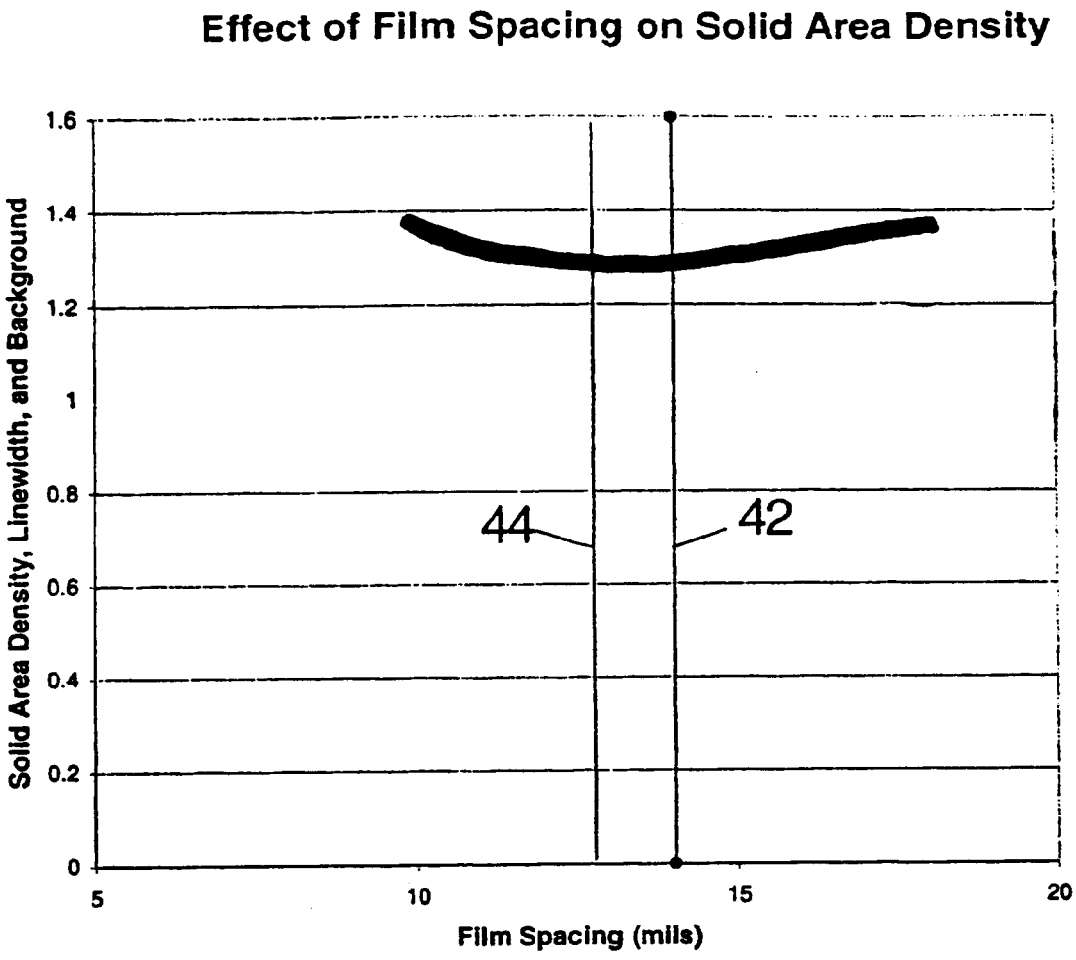
FIG. 12 presents a plot of electrostatic imaging member spacing relative to the magnetic brush shell versus toning density.

Referring now to FIG. 11, a plot of skive spacing versus toning density is presented, showing a skive space setpoint 38, and an actual maximum 40. Skive spacing S is presented in FIG. 1. Skive spacing is preferably set at the spacing S where the slope is approximately zero and also a maximum. Referring now to FIG. 12, a plot of film spacing relative to the shell 18 is presented, showing a film spacing setpoint 42 and an actual minimum 44. Film spacing M is presented in FIG. 1. Film spacing is preferably set at the spacing M where the slope is approximately zero and also a minimum. In FIGS. 11 and 12, the setpoints 38 and 42 are not set at the actual maximum 40 and minimum 44, respectively, in order to illustrate application of the invention in realistic situations wherein mechanical tolerances, for example, +/−0.003 inches, are taken into account. The invention is useful if the optimum operating point falls within the tolerance range. The curves presented in FIGS. 10–12 are determined experimentally, and can vary depending upon the particular application.

Figure 13:
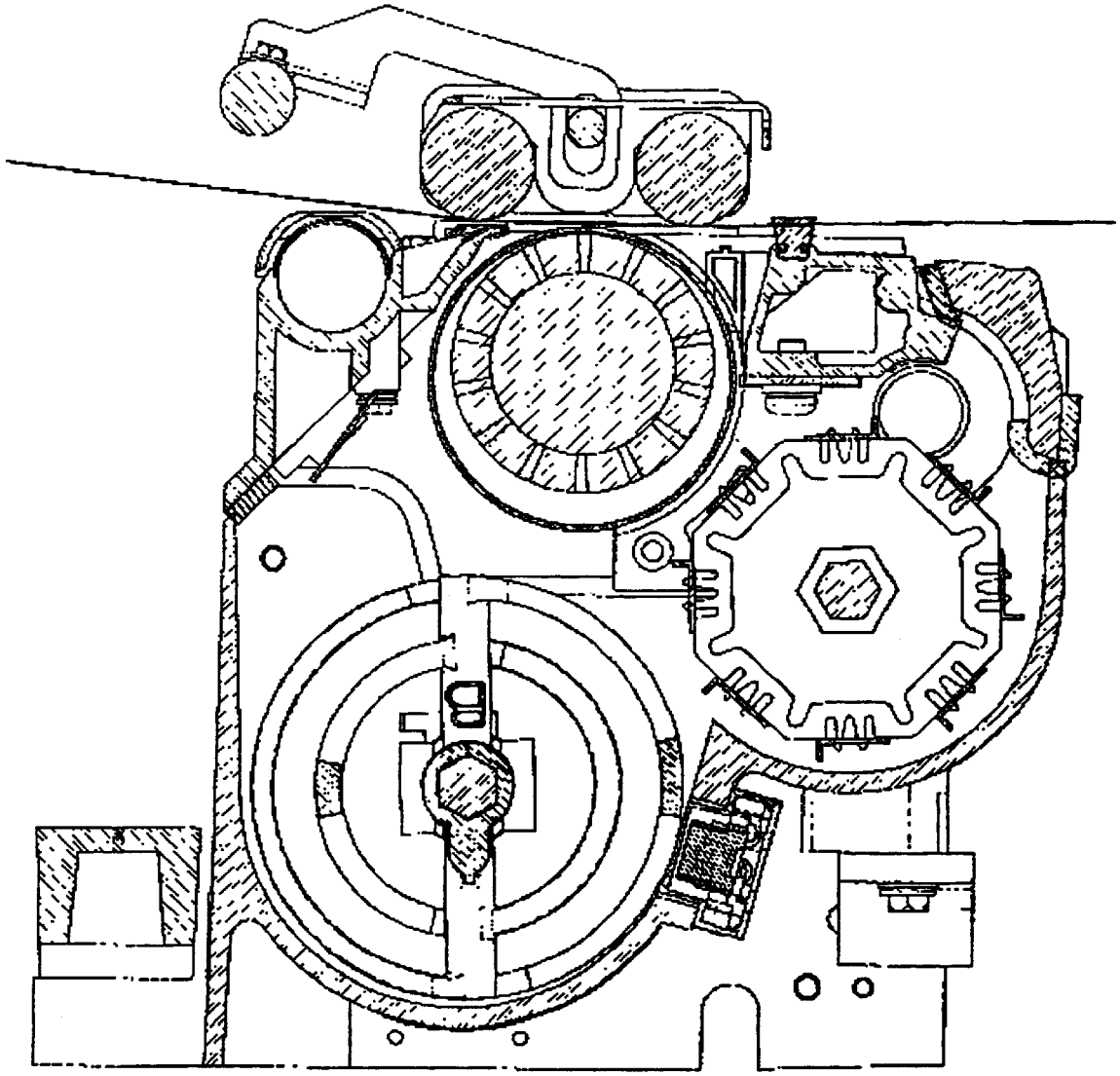
FIG. 13 presents a cross-sectional view of a toning station that implements the development apparatus of FIG. 1.

Referring now to FIG. 13, a development station is presented of the type that implements the development apparatus 10 according to the present invention. The toning station has a nominally 2" diameter stainless steel toning shell containing a 14 pole magnetic core. Each alternating north and south pole has a field strength of approximately 1000 gauss. The toner has diameter 11.5 microns. The hard magnetic carrier has diameter of approximately 30 microns and resistivity of $10^{11}$ ohm-cm. The starting point for tests at process speeds greater than 110 PPM was to increase toning station speeds proportionally to photoconductor speed, as shown below.

Figure 14:
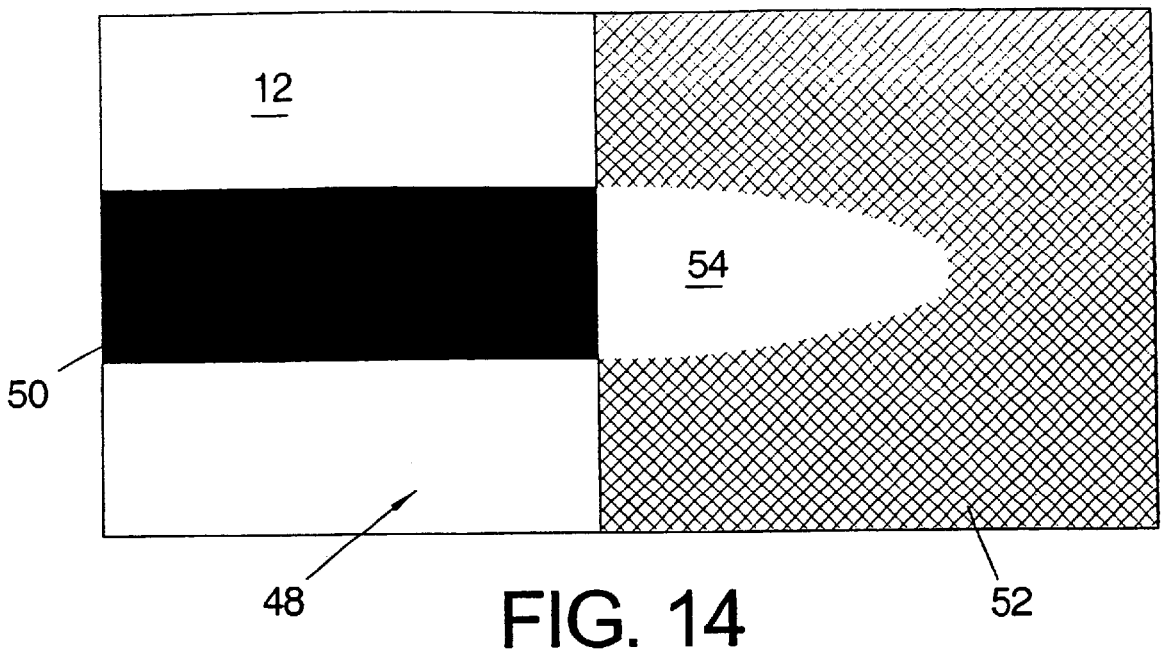
FIG. 14 presents a toned image comprising a solid area followed by a half-tone or grey area.

Image artifacts can be produced during toning at high process speeds by the countercharge in the developer, for example the positive charges noted in FIG. 3. The countercharge can cause solid areas to have dark leading edges and light trail edges. For solid areas embedded in halftone fields, a halo artifact can occur at the trail edge of the solid area, as presented in FIG. 14. Referring to FIG. 14, the photoconductor 12 comprises a developed image 48 having an elongate solid area 50 followed by a half-tone area 52. Note that an undeveloped halo area 54 immediately follows the solid area 50. The halo area 54 is generated due to build up of positive charge in the developer 16 while toning the solid area 50.

Figure 15:
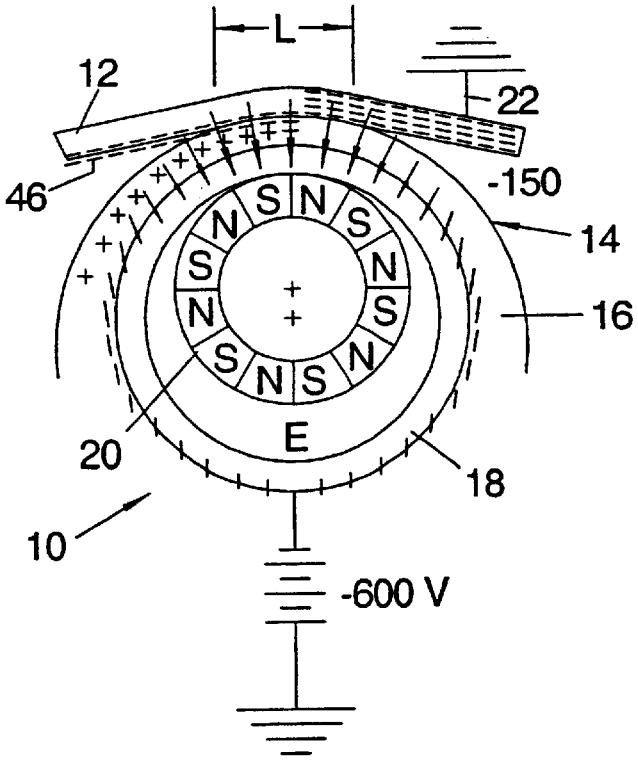
FIG. 15 presents development process of the FIG. 14 image, according to an aspect of the invention.

For a given shell speed and photoconductor speed, the extent of the halo can be used to estimate the value of shell speed needed to prevent this problem. Referring now to FIG. 15, development of image 48 of FIG. 14 is presented. The trailing edge of the solid area 50 is at the center of the toning zone of width L. The toning shell adjacent the trail edge has been exposed to the solid area for time $$t=(L/2)/V_s, \tag{1}$$

where $V_s$ is toning shell velocity. The time t in seconds also represents a number of toning time constants and countercharge removal time constants. Until this location on the toning shell leaves the toning zone, it will be adjacent the photoconductor for a distance x on the photoconductor, with x given by $$x=t(V_m-V_s), \tag{2}$$

where $V_m$ is the photoconductor velocity. From (1) and (2), $$x=(L/2)(V_m-V_s)/V_s. \tag{3}$$

Where x=5/16" for the extent of the halo at 110 PPM, with the halo measured from the trail edge of the solid to the point in the subsequent gray area where image density has recovered to half its normal density. The toning nip has effective width L of approximately 0.352". According to this example, $V_s$ greater than 75% of $V_m$ reduces the halo to less than 1/16" in length. According to an aspect of the invention, the halo is minimized, but not entirely eliminated, since the countercharge is removed by flow of the developer 16. Increasing shell speed Vs increases the flow rate of developer, increases the rate of removal of countercharge from the development zone L, and minimizes halo.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. For example, the invention can be used with electrophotographic or electrographic images. The invention can be used with imaging elements or photoconductors in either web or drum formats. Optimized setpoints for some embodiments may be attained using reflection density instead of transmission density, and the exact values of optimum setpoints may depend on the geometry of particular embodiments or particular characteristics of development in those embodiments. It is therefore intended to include within the invention all such variations and modifications as fall within the scope of the appended claims and equivalents thereof.

We claim:

1. A process for developing electrostatic images, comprising:

moving an electrostatic imaging member having an electrostatic image at a member velocity;

rotating a shell with a shell surface velocity adjacent said electrostatic imaging member and co-directional with said member velocity; and rotating a plurality of magnetic poles inside said shell, said shell and said magnetic poles bringing a mixture of toner and hard magnetic carriers into contact with said electrostatic imaging member thereby depositing toner on said electrostatic image;

said shell surface velocity being greater than a shell surface velocity that creates noticeably greater toner density on leading edges of said electrostatic image than on the balance of said electrostatic image, and less than a shell surface velocity that creates noticeably greater toner density on trailing edges of said electrostatic image than on the balance of said electrostatic image.

2. The process of claim 1, wherein said member velocity is at least 11.4 inches per second.

3. The process of claim 1, wherein said member velocity is greater than 15 inches per second.

4. The process of claim 1, further comprising a development zone length where said mixture of toner and hard magnetic carriers contact said electrostatic imaging member that is greater than 0.25 inches.

5. The process of claim 1, wherein said shell surface velocity that creates noticeably greater toner density on leading edges of said electrostatic image than on the balance of said electrostatic image is less than 40% of said member velocity, and shell surface velocity that creates noticeably greater toner density on trailing edges of said electrostatic image than on the balance of said electrostatic image is greater than 105% of said member velocity.

6. The process of claim 1, wherein said shell surface velocity that creates noticeably greater toner density on leading edges of said electrostatic image than on the balance of said electrostatic image is less than 50% of said member velocity, and shell surface velocity that creates noticeably greater toner density on trailing edges of said electrostatic image than on the balance of said electrostatic image is greater than 105% of said member velocity.

7. The process of claim 1, wherein said shell surface velocity that creates noticeably greater toner density on leading edges of said electrostatic image than on the balance of said electrostatic image is less than 50% of said member velocity, and shell surface velocity that creates noticeably greater toner density on trailing edges of said electrostatic image than on the balance of said electrostatic image is greater than 100% of said member velocity.

8. A process for developing electrostatic images, comprising:

moving an electrostatic imaging member having an electrostatic image at a member velocity, said electrostatic image having leading edges and trailing edges;

rotating a shell with a shell surface velocity adjacent said electrostatic imaging member and co-directional with said member velocity; and rotating a plurality of magnetic poles inside a shell and rotating said shell with a shell surface velocity co-directional with said member velocity, said shell and said magnetic poles bringing a mixture of toner and hard magnetic carriers into contact with said electrostatic imaging member thereby depositing toner on said electrostatic image with a toner density wherein (a) there is a minimum shell surface velocity below which toner density on said leading edges is noticeably greater than on the balance of said electrostatic image, and (b) there is a maximum shell surface velocity above which toner density on said trailing edges is noticeably greater than on the balance of said electrostatic image, said shell surface velocity being greater than or equal to said minimum shell surface velocity and less than or equal to said maximum shell surface velocity.

9. The process of claim 8, wherein said member velocity is at least 11.4 inches per second.

10. The process of claim 8, wherein said member velocity is greater than 15 inches per second.

11. The process of claim 8, further comprising a development zone length where said mixture of toner and hard magnetic carriers contact said electrostatic imaging member that is greater than 0.25 inches.

12. The process of claim 8, wherein said minimum shell velocity is 40% of said member velocity and said maximum shell velocity is 105% of said member velocity.

13. The process of claim 8, wherein said minimum shell velocity is 50% of said member velocity and said maximum shell velocity is 105% of said member velocity.

14. The process of claim 8, wherein said minimum shell velocity is 50% of said member velocity and said maximum shell velocity is 100% of said member velocity.

* * * * *